US010625322B2

(12) United States Patent
Ghiotti

(10) Patent No.: US 10,625,322 B2
(45) Date of Patent: Apr. 21, 2020

(54) APPARATUS FOR IMPROVING THE QUALITY OF TUBE BENDING AND METHOD THAT USES SUCH APPARATUS

(71) Applicant: MODELIA S.R.L., Abano Terme (IT)

(72) Inventor: Andrea Ghiotti, Padua (IT)

(73) Assignee: BLM S.P.A., Cantu, Como (IT)

( * ) Notice: Subject to any disclaimer, the term of this patent is extended or adjusted under 35 U.S.C. 154(b) by 153 days.

(21) Appl. No.: 15/562,926

(22) PCT Filed: Mar. 31, 2016

(86) PCT No.: PCT/IB2016/051833

§ 371 (c)(1),
(2) Date: Sep. 29, 2017

(87) PCT Pub. No.: WO2016/157115

PCT Pub. Date: Oct. 6, 2016

(65) Prior Publication Data

US 2018/0085809 A1 Mar. 29, 2018

(30) Foreign Application Priority Data

Apr. 1, 2015 (IT) ..... PD2015A0068

(51) Int. Cl.
*B21D 9/03* (2006.01)
*B21D 9/05* (2006.01)

(52) U.S. Cl.
CPC ..... *B21D 9/03* (2013.01); *B21D 9/05* (2013.01)

(58) Field of Classification Search
CPC ... B21D 9/01; B21D 9/03; B21D 9/05; B21D 39/20; B21D 41/026; B21D 41/028
See application file for complete search history.

(56) References Cited

U.S. PATENT DOCUMENTS 4,876,872 A * 10/1989 Kaneko ..... B21D 9/125 72/133
5,632,176 A * 5/1997 Bhandari ..... B21D 7/025 72/149
8,322,185 B2 * 12/2012 Farzin ..... B21D 9/03 72/369

(Continued)

FOREIGN PATENT DOCUMENTS

EP 0677342 A2 10/1995
KR 20110064522 A 6/2011

OTHER PUBLICATIONS

International Search Report and Written Opinion dated Jul. 13, 2016 issued in PCT/IB2016/051833.

(Continued)

*Primary Examiner* — Teresa M Ekiert
(74) *Attorney, Agent, or Firm* — Scully, Scott, Murphy & Presser, P.C.

(57) ABSTRACT

An apparatus for improving the quality of tube bending; adapted to be used in bending machines and comprises a substantially longitudinally extended mandrel, adapted to be inserted into a tube to be bent and having a rigid portion and a flexible portion arranged in series, the latter comprising a series of mandrel segments connected by articulated joints; the apparatus also comprises at least one motion-sensitive sensor, which is integral with at least one of the mandrel segments, and elements for processing the motion information acquired by the sensor.

13 Claims, 7 Drawing Sheets

(56) References Cited

U.S. PATENT DOCUMENTS

| | | | | |
|---|---|---|---|---|
| 9,744,628 | B1 * | 8/2017 | Kuo | B23P 9/025 |
| 2007/0186603 | A1 | 8/2007 | Hogendoorn et al. | |
| 2010/0095736 | A1 * | 4/2010 | Kolbe | B21D 3/05 72/370.08 |
| 2012/0167372 | A1 * | 7/2012 | Spink | B21D 26/14 29/509 |

OTHER PUBLICATIONS

Italian Search Report and Written Opinion dated Dec. 1, 2015 issued in IT PD20150068 with partial translation.

* cited by examiner

APPARATUS FOR IMPROVING THE QUALITY OF TUBE BENDING AND METHOD THAT USES SUCH APPARATUS

The present invention relates to an apparatus for improving the quality of tube bending and to a method that uses the apparatus.

Tube bending operations are often complex owing to inconveniences that can arise during processing, such as the elastic return of the tube that has just been bent, the flattening or collapse of the tube, the variation of the actual deformation with respect to the design deformation which can be observed in a different radius of curvature, or forming and surface defects, including the forming of wrinkles at the inside curve of the bent tube.

With a tube bending machine, even provided with numerical control, it is difficult to obtain the set bending angle due to the fact that the material being processed, which is typically metallic, has an elasticity such that when the bent product is released from the machine it tends to resume part of the deformation imposed on it, causing elastic return.

When possible, elastic return is compensated with overbending, imposing curvature radiuses that are smaller than those of the final curvature of the parts.

One of the most widespread bending methods is draw bending, which uses a bending machine with which the tube is clamped between a bending template and a vise and these are made to rotate while a third element and a fourth element retain the piece in the region upstream of the portion to be bent.

Another equally widespread method that is often preferred for relatively large radiuses of curvature is calendering, according to which the tube is pushed through a set of rollers the center distance of which can be changed in order to vary the radius of curvature imposed on the tube. With these methods the phenomenon of elastic return occurs at different times.

In the first case, the elastic return occurs at the instant when the vise releases the tube, whereas with calendering it occurs continuously at the exit from the set of rollers that deform it.

Knowing the final shape of the processed part, and therefore the elastic return, is fundamental because it allows the designer to apply a correction to the bending angle or to the radius of curvature.

Currently, some methods for measuring the bending angle and the curvature of the tube are known. The most obvious method is the one that provides for removing the tube from the bending machine and checking the final geometry with adapted measurement instruments. However, this method is costly both in terms of time and in economic terms.

With draw bending, solutions are also known which provide for the use of contact sensors or of vision systems combined with laser emitters in order to determine the final orientation of the portion of tube downstream of the bend.

These measurement systems have significant limitations: the former are suited to be applied exclusively for measuring angles comprised between two straight portions, and with the latter the measurement depends on the lighting and on the cleanliness conditions of the observed surface.

With bending by calendering, the fact that the bend is not comprised between two straight portions increases further the complexity of determining the elastic return, since the possibility to measure the final bending angle from the relative orientation of the two portions is no longer available.

Methods are known which use measurement apparatuses arranged in the region downstream of the rollers. For example, it is possible to place three probes in contact with the surface of the part, the signals of which are processed in order to determine the radius of curvature downstream of the rollers during bending.

Furthermore, the cited solutions do not lend themselves to both of the bending methods described above and therefore they do not take into account the fact that the tube bending process performed on numerically controlled machines is a highly automated process in which in many cases what is performed is not single bends but series of bends which require continual reorientations not only of the tube but sometimes even of the entire set of templates and rollers, and often also the application of both bending methods to the same component. In this case the measurement elements, which are external, must also be reoriented.

As mentioned earlier, other drawbacks can be observed during the operations for bending tubes, i.e., collapse, the forming of wrinkles at the inside curve of the tube in the bending region and, neither last nor least, possible deviations of the actual radius of curvature from the design radius.

The latter is a substantial drawback in the process for bending by calendering, and currently the need to monitor the process in order to apply the appropriate corrections in real time is particularly felt. However, good solutions are not known.

Currently, in order to avoid the collapse of the tube and limit the risk of wrinkles forming in the bending region, a longitudinally extended mandrel is used which is substantially composed of two main parts: a rigid portion, with one end of which a rigid rod is normally associated, and a series of segments, commonly known as "rings", at the opposite and of the rigid portion, which are mutually connected by way of spherical joints.

Although in Italy this object is commonly known in the tube bending sector as "anima di piegatura" ("bending core"), in English-speaking countries this is known as a "bending mandrel".

The tube bending mandrel is inserted in the tube before bending, with the series of rings arranged at the portion of tube to be curved. The number of rings is variable depending on the length of the portion of tube to be curved and these rings are capable of following the change of shape of the tube during bending.

Use of the mandrel appears to solve the problem of collapse, but it does not entirely solve the problem of the forming of wrinkles, which at the end of the bending process must be detected and examined with the naked eye or by way of vision systems or proximity sensors, depending on their extent, requiring instruments that are an addition to the bending machines and are capable of analyzing the processed part exclusively from the outside thereof and at the end of the deformation.

A further drawback of the methods and equipment known currently is that bending can be checked only with adapted instruments for each requirement, i.e., instruments dedicated to checking the bending angle or the curvature, a mandrel for preventing the collapse of the tube and instruments dedicated to the analysis of surface defects.

The aim of the present invention is to propose an apparatus and a method for improving the quality of tube bending, by measuring precisely and in real time the bending angle and the curvature of the tube, recognizing any deformation errors that can arise during the bending process, including elastic return and deviations from the set radius of curvature, in order to be able to apply the appropriate corrections to the process without interrupting it for measurements.

Within the scope of this aim, an object of the invention is to provide a method and an apparatus that can be applied to multiple types of tube bending process, including draw bending and bending by calendering.

Another object of the invention is to provide an apparatus that can be used even if it is necessary to perform a series of bends that require continual reorientations of the set of templates and rollers and/or the application of multiple bending methods on the same component.

A further object of the invention is also to control the wrinkles caused by bending in a different manner from what has been proposed to date.

This aim, as well as these and other objects that will become better apparent hereinafter, are achieved by an apparatus for improving the quality of tube bending, adapted to be used in bending machines and comprising a substantially longitudinally extended mandrel, adapted to be inserted in a tube to be bent and having a rigid portion and a flexible portion arranged in series, said flexible portion comprising a series of mandrel segments connected by means of articulated joints, said apparatus being characterized in that it comprises:

- at least one motion-sensitive sensor, which is integral with at least one of said mandrel segments,
- means for processing the motion information acquired by said at least one sensor.

The invention also relates to a method that uses the apparatus described above, which consists in:

- inserting a said mandrel in said tube,
- acquiring the position of said at least one mandrel segment with which said at least one sensor is integral,
- bending said tube according to preset process parameters,
- detecting the motion and measuring the displacement of said at least one mandrel segment, with which said at least one sensor is integral, during the bending and/or after the bending of said tube,
- comparing the measured displacement with the preset process displacement and, if they are different, processing a correction of said process parameters,
- bending said tube again or bending another tube according to the corrected process parameters.

Further characteristics and advantages of the invention will become better apparent from the description of two preferred but not exclusive embodiments of the apparatus according to the invention, which are illustrated by way of non-limiting example in the accompanying drawings, wherein.

Figure 1:
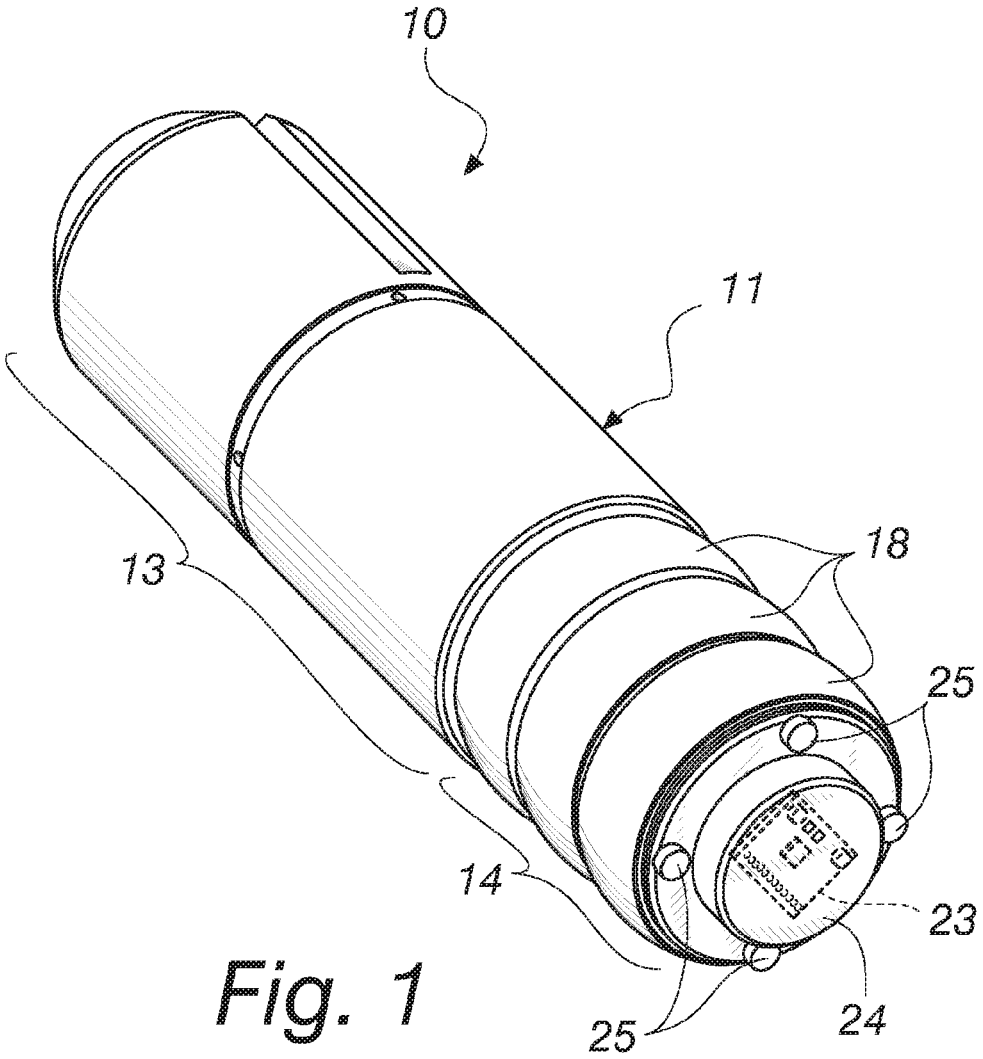
FIG. 1 is a perspective view of the apparatus according to the invention in a first embodiment thereof.
Figure 2:
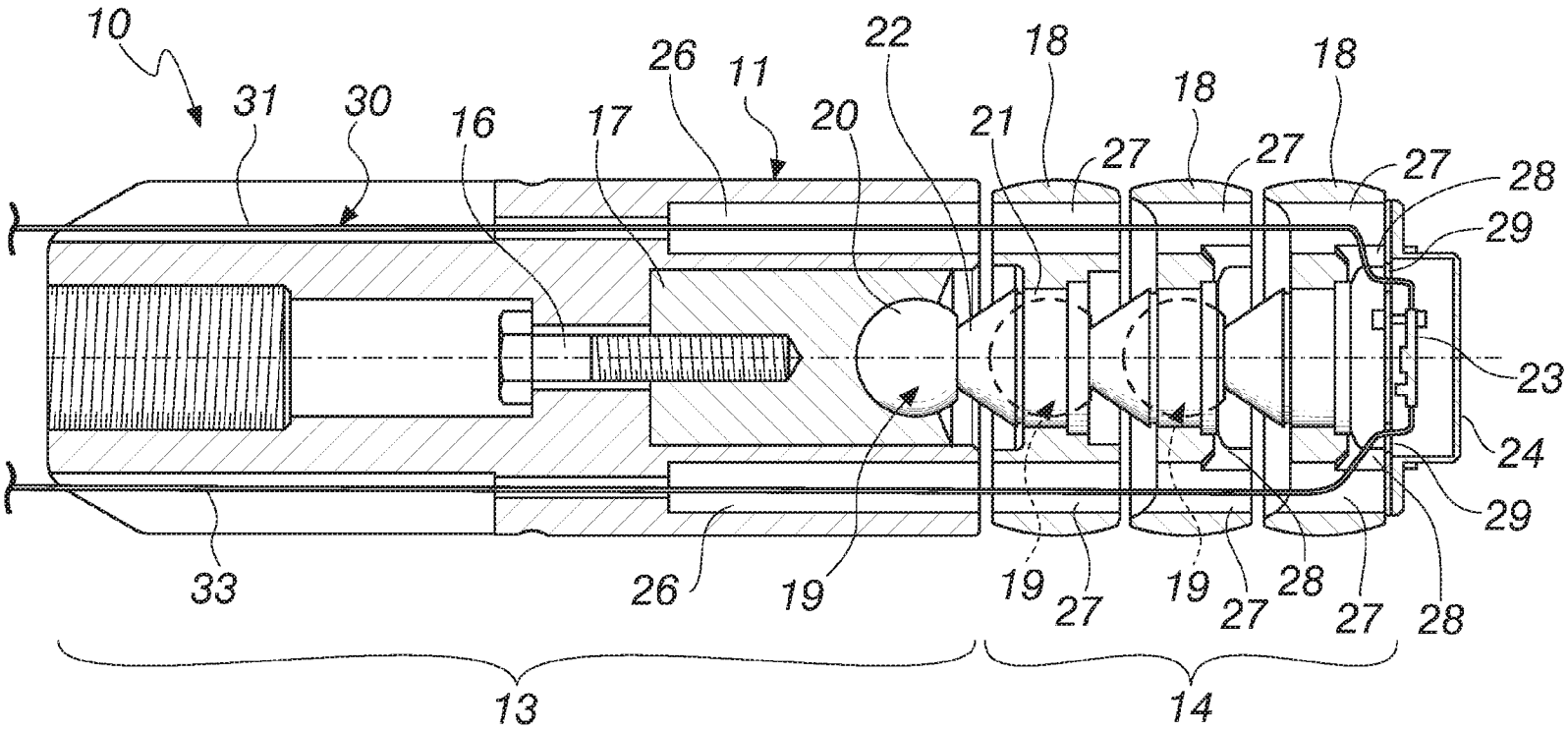
FIG. 2 is a longitudinal cross-sectional view of the apparatus of FIG. 1.
Figure 3:
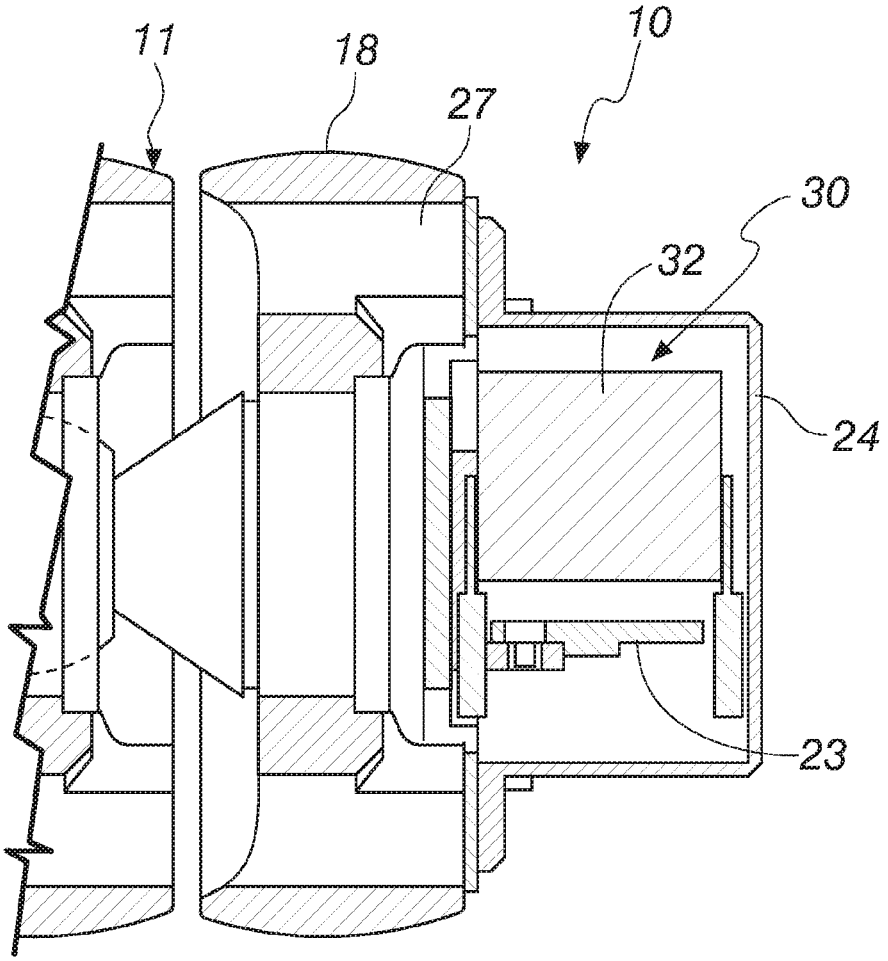
FIG. 3 is a cross-sectional view of a portion of the apparatus according to the invention in a variation of the first embodiment.
Figure 5:
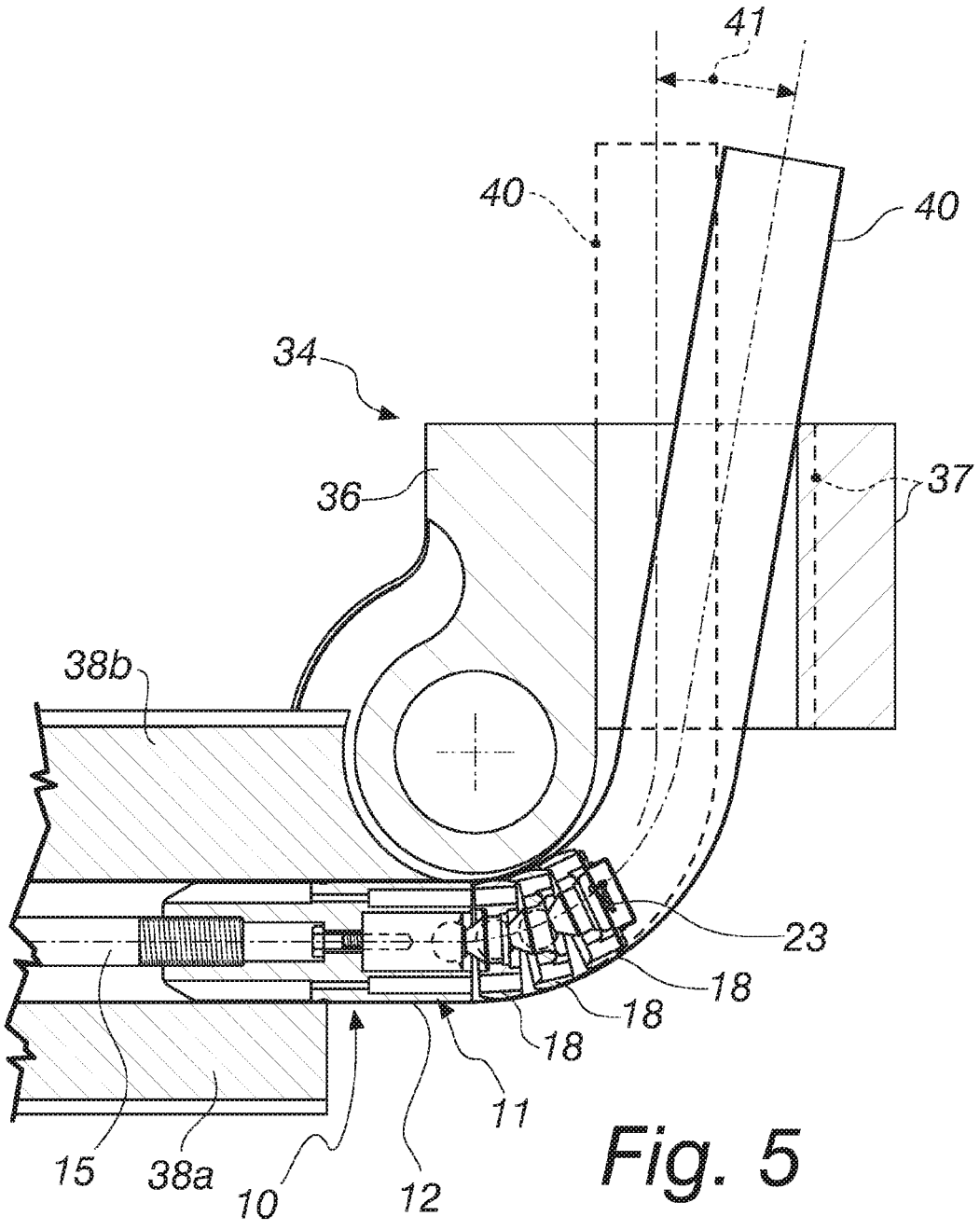
FIG. 5 is a view of the use of the apparatus according to the invention in its first embodiment during the bending of a tube with a draw bending machine.
Figure 6:
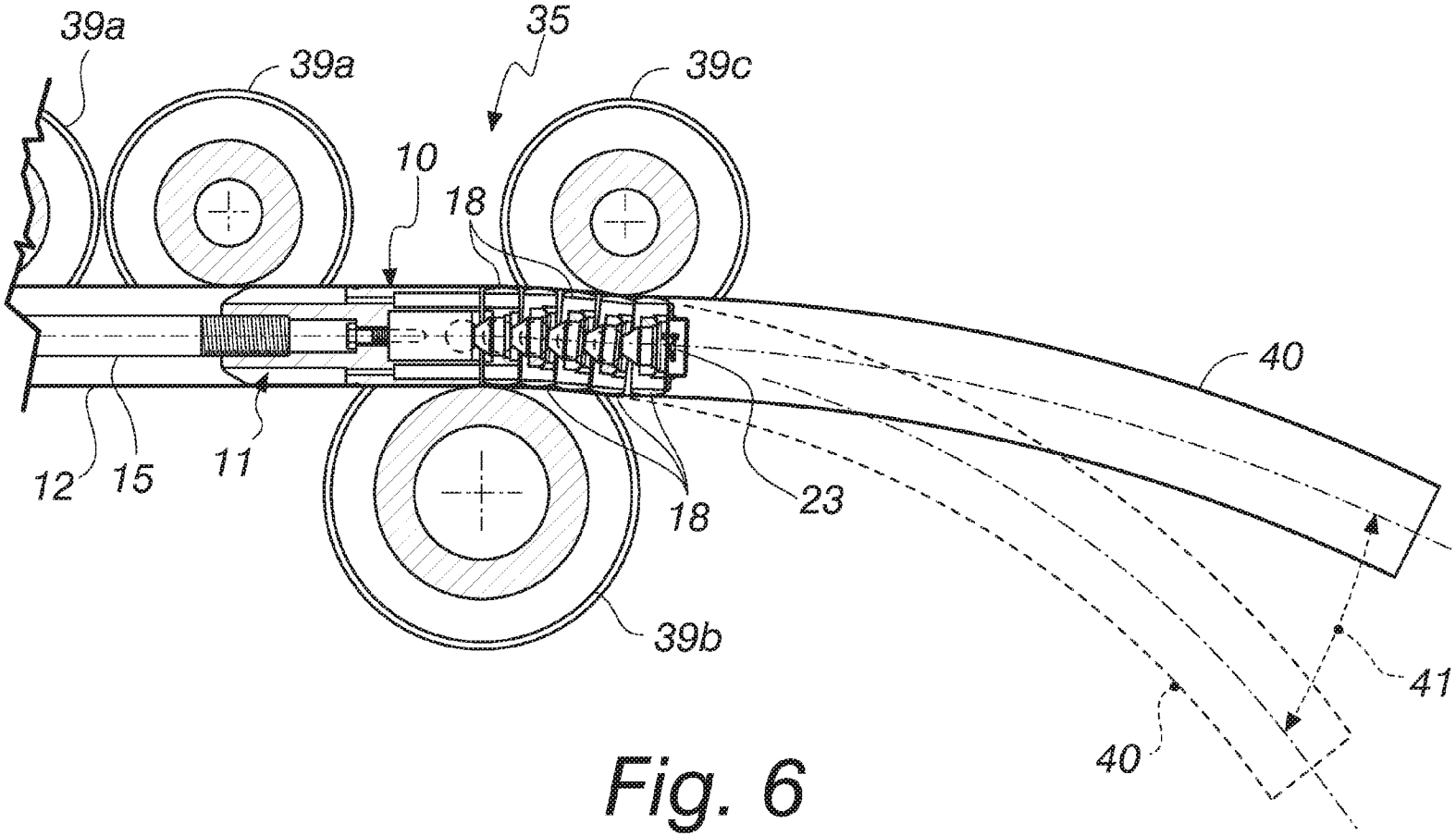
FIG. 6 is a view of the use of the apparatus according to the invention in its first embodiment during the bending of a tube with a calendering machine.

With reference to FIGS. 1 to 3 and to FIGS. 5 and 6, the apparatus according to the invention is generally designated by the reference numeral 10 in its first embodiment.

It comprises a tube bending mandrel 11, which is of a type known in the sector and known in English-speaking countries as "bending mandrel".

The mandrel 11, which has a longitudinal extension and can be made of metallic material and/or of plastic material, is adapted to be inserted within the tube 12 to be bent and has a rigid portion 13 and a flexible portion 14 which are arranged in series, as is clearly visible in the perspective view of FIG. 1 and in the cross-sectional view of FIG. 2. It has a preferably circular cross-section, as shown, but it can also have other shapes as a function of the geometry of the tube to be bent.

In a fully known manner, a rod 15, shown in FIG. 5 and in FIG. 6, can be associated appropriately with the mandrel 11 on the free side of the rigid portion 13 in order to insert it into and extract it from the tube 12.

There is also a screw 16 in the cavity of the rigid portion 13, for the association of an internal part 17 with the remaining part of the rigid portion 13. The flexible portion 14 is adapted to flex inside the tube 12 according to the curvature thereof and for this reason it comprises a series of mandrel segments 18 which are connected by means of articulated joints 19, clearly visible in FIG. 2 in cross-section.

The first mandrel segment 18, on the side of the rigid portion 13, is also connected thereto by means of one of these articulated joints 19.

These articulated joints 19 are of a known type. In the illustrated example they are constituted mainly by a spherical portion 20 and by a hollow portion 21, the cavity of which is shaped complementarily to the spherical portion 20. In this manner the articulated joints 19 can be connected in series by inserting the spherical portion 20 of one into the hollow portion 21 of the other. The two portions are connected by an intermediate portion 22, which has a narrowed cross-section in order to avoid hindering the movement of one joint on the other. Each joint is mounted, in a known manner, so that the hollow portion 21 lies inside a respective mandrel segment 18 and protrudes with the remaining part in order to enter with its spherical portion 20 the hollow portion 21 of another, similar articulated joint 19, which is also mounted within a respective mandrel segment 18, thus creating the association between the two segments, except for one of the joints, for which the spherical portion 20 is inserted in an adapted cavity on the internal part 17 of the rigid portion 13.

In this manner, the number of mandrel segments 18 can be varied as required. In FIGS. 1, 2 and 5 the mandrel 11 comprises, by way of example, three mandrel segments 18, while in FIG. 6 it comprises, again by way of example, five mandrel segments 18.

The apparatus 10 also comprises a motion-sensitive sensor 23, which is integral with a mandrel segment 18 the movements of which are to be detected, and means (not shown) for processing the motion information detected by the sensor 23.

In particular, said sensor 23 is installed on the mandrel segment 18 at the free end of the flexible portion 14. Said mandrel segment 18 is the last one of the series, and the sensor 23 is accommodated within a protective box 24 which is fixed to the mandrel segment 18 by virtue of four fixing screws 25.

The sensor 23 is part of an inertial platform (the entire system is indicated for the sake of simplicity as the sensor 23) for detecting the orientation and the displacements in an inertial system. The example shows a single sensor 23 and this sensor, being chosen preferably but not exclusively from between a triaxial accelerometer and a triaxial gyroscope, is sensitive to motion and therefore is capable of detecting the motion of the mandrel segment 18 on which it is installed.

As an alternative, both an accelerometer and a gyroscope may be present, mounted on the same platform.

Other types of sensor, for example, compass sensors or magnetometers, can also be used.

The above cited processing means comprise at least one software program and at least one hardware processing device, for example a computer if external to the tube 12, to be used together with the software, which are adapted to measure at least the displacements of the mandrel segment 18 with which the sensor 23 is integral, integrating the information received from said sensor 23.

As an alternative, the processing device can consist of a microcontroller, to be combined with the software program, which is installed at the sensor, to which it is connected in order to receive the information, i.e., the motion signals, to be processed. In this case, the processing means can also comprise a computer to which the processing device can be connected for further data processing.

As can be seen from the figure in cross-section, the mandrel 11 has two diametrically opposite first holes 26 which pass longitudinally through the rigid portion 13 and, in series with them, a series of second holes 27, each one of which passes through a corresponding mandrel segment 18 and which are also diametrically opposite. At least the mandrel segment 18 with which the sensor 23 is integral has two channels 28, which consist substantially of transverse holes provided in a substantially radial direction with respect to said mandrel segment 18, for the connection of the second holes 27 to the inside of the protective box 24, which conveniently also has two holes 29, at its coupling to said mandrel segment 18.

In the illustrated examples, the other mandrel segments 18, except for the first one of the series, arranged in series with the rigid portion 13, also have channels 28, but may also lack them.

The apparatus 10 conveniently comprises means 30 for the electric power supply of the sensor 23, which in the first version of the apparatus 10 comprise at least one electrical cable 31 (one in the illustration, and shown only in FIG. 2), which connects the sensor 23 to an electrical system that is external to the mandrel 11, passing in series through a hole 29, a channel 28, a series of second holes 27 and a first hole 26.

In a second version of the apparatus 10, of which FIG. 3 shows only a portion at the sensor 23 installed on the mandrel segment 18, the electric power supply means 30 comprise a battery 32 which is coupled to the sensor 23.

In this case the protective box 24 of the illustrated example conveniently is larger in order to also contain the battery 32.

The apparatus 10 comprises means for transmitting the data from the sensor 23 to the processing means, for radiofrequency or wired transmission.

The microcontroller, if present, or the sensor 23 can in fact send the signals, processed or to be processed, to the external hardware by wireless communication or by means of cables.

In the example of FIG. 2, the data transmission means comprise a data transmission cable 33 which connects the sensor 23 to the processing means, externally to the tube 12, by passing in series through a hole 29, a channel 28, a series of second holes 27 and a first hole 26. The data transmission cable 33 allows the transmission of the signals detected by the sensor 23 to the processing means, or of the data, already processed by the microcontroller, to an external computer for display or to the computer for numerical control of the bending machine.

As a function of the total quantity of cables required for electric power supply and for data transmission, there can be only one or more than two first holes 26 and correspondingly only one or more than two series of second holes 27 and only one or multiple channels 28.

In the version with a battery 32, the mandrel 11 can lack holes and channels if the data transmission is obtained wirelessly.

Figure 4:
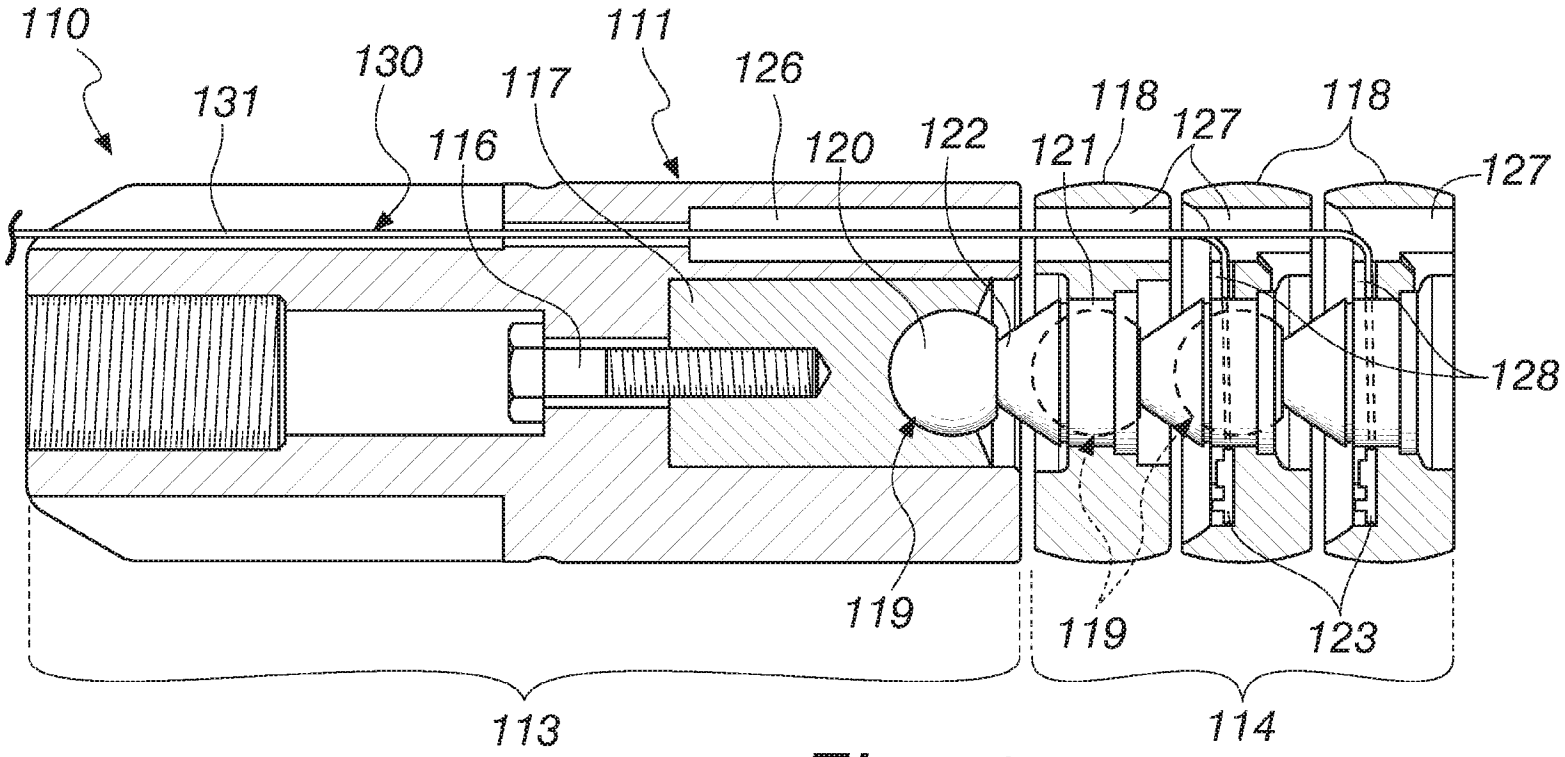
FIG. 4 is a longitudinal cross-sectional view of the apparatus according to the invention in a second embodiment thereof.
Figure 7:
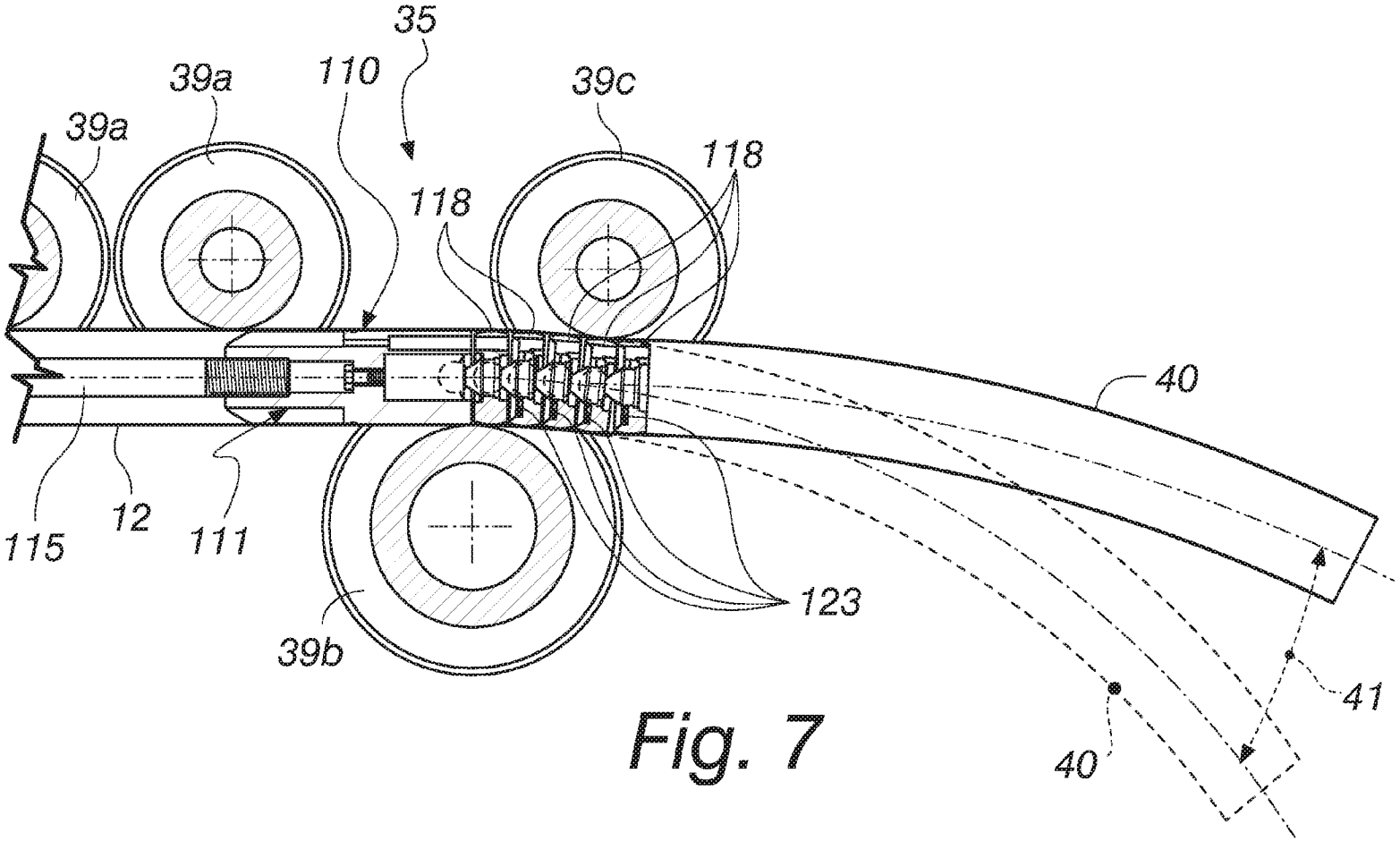
FIG. 7 is a view of the use of the apparatus according to the invention in its second embodiment during the bending of a tube with a calendering machine.

With reference to FIGS. 4 and 7, the apparatus according to the invention is generally designated by the reference numeral 110 in its second embodiment.

It comprises a mandrel 111 for bending tubes, which is of a type known in the field.

The mandrel 111, as in the preceding embodiment, is extended longitudinally and can be made of metallic material and/or plastic material. It is adapted to be inserted within the tube 12 to be bent, as shown in the example of FIG. 7, and it has a rigid portion 113 and a flexible portion 114 which are arranged in series.

The cross-section is again circular, but it can also have other shapes.

A rod 115 can be associated conveniently with the mandrel 111 on the free side of the rigid portion 113, which has a cavity into which a screw 116 is screwed for the association of an internal part 117. The flexible portion 114 is adapted to flex within the tube 12 according to the curvature of the latter and for this reason it comprises, in this embodiment also, a series of mandrel segments 118 which are connected by means of articulated joints 119, which are clearly visible in the cross-sectional views. The first mandrel segment 118, on the side of the rigid portion 113, is also connected thereto by means of one of these articulated joints 119.

These articulated joints 119 are of a known type and in the illustrated examples they are similar to the ones shown for the preceding embodiment. They are constituted mainly by a spherical portion 120 and by a hollow portion 121, the cavity of which is shaped complementarily to the spherical portion 120, and are connected by an intermediate portion 122.

The number of mandrel segments 118 can be varied by connecting them by means of the articulated joints 119. In the example shown in FIG. 4, the mandrel 111 has three mandrel segments 118, whereas in FIG. 7, again by way of example, it has five.

The apparatus 110 also comprises at least one motion-sensitive sensor 123 which is integral with a mandrel segment 118 the movements of which are to be detected, and means (not shown) for processing the motion information detected by the sensor 123. In the examples shown there are multiple sensors 123, each one at a respective mandrel segment 118 the movements of which are to be detected. Nonetheless, there can be more than one sensor 123 for each mandrel segment 118 to be monitored.

In this embodiment of the apparatus 110, each sensor 123 is accommodated within a respective mandrel segment 118, in an adapted receptacle.

In the example of FIG. 4 there are three mandrel segments 118, of which only the last two, toward the free end of the flexible portion 114, are provided with a sensor 123. The displacements of the mandrel segment 118 in series with the rigid portion 113 are of less interest, since of all of them it is the segment that undergoes the least motion during the flexing of the mandrel 111 in the tube 12.

For the same reason, in the example of FIG. 7 only the last four of the five mandrel segments 118 are provided with a sensor 123.

Each one of the sensors 123 is part of an inertial platform (the entire system is referenced for the sake of simplicity as the sensor 123) for detecting movements in an inertial system. In this case also, it can be a triaxial accelerometer or triaxial gyroscope, or both can be mounted on the same platform, in the case where there are two sensors on the same mandrel segment.

Other types of sensor, for example compass sensors or magnetometers, can also be used.

The above cited processing means comprise at least one software program and at least one hardware processing device, for example an external computer, to be used together with the software, which are adapted to measure at least the displacements of each mandrel segment 118 with which a sensor 123 is integral. As an alternative, the processing device can consist of a microcontroller, to be combined with the software, which is installed at the respective sensor 123, to which it is connected in order to receive the information, i.e., the motion signals, to be processed.

The microcontroller can also be connected to another processing device, for example an external computer, for further data processing, or to the computer for numerical control of the bending machine.

The cross-sectional view shows that the mandrel 111 has a first hole 126 which passes longitudinally through the rigid portion 113 and, in series therewith, a series of second holes 127, each one of which passes through a corresponding mandrel segment 118. The mandrel segments 118 with which a respective sensor 123 is integral also have a semicircular channel 128 for connection between the sensor 123 and the second hole 127, for the passage of cables.

The apparatus 110 conveniently comprises means 130 for the electric power supply of the sensors 123, which comprise at least one electrical cable 131 (shown only in this figure) for connecting each sensor 123 to an electrical system that is external to the mandrel 111, passing in series through a channel 128, second holes 127 and a first hole 126. The electrical cable 131 has branches, each toward a mandrel segment 118, but as an alternative there can be more than one of such cables, each one for each sensor 123.

The apparatus 110 comprises means for transmitting the data from the sensor 123 to the processing means, for radiofrequency or wired transmission.

The microcontroller, if present, or the sensor 123 can in fact send the signals, processed or to be processed, to the external hardware by wireless communication or by means of cables.

In the example, the transmission of the detected signals from the sensor 123 to the signal processing means outside the tube 12, or of the data already processed by the microcontroller to an external computer for display, occurs wirelessly. However, in alternative versions the transmission can be obtained by means of adapted data transmission cables that connect each sensor or each microcontroller to the external hardware, passing through the mandrel 111 in the same holes as the electrical cable 131.

As a function of the total quantity of cables required for electric power supply and data transmission, there can be only one or more than two first holes 126 and only one or more than two series of second holes 127.

According to other versions of the apparatus 110 according to the invention, not shown, in addition to a different number of mandrel segments with respect to the ones shown, there can be sensors in selected mandrel segments, or even in only one of them, for example the one at the free end of the flexible portion 114, as in the first embodiment.

FIGS. 5 to 7 show processes for bending the tube using the apparatus according to the invention in its two embodiments 10 and 110 and with reference to these figures the method according to the invention, which uses these embodiments of the apparatus 10 and 110, is described.

In particular, FIG. 5 shows the use of an apparatus 10 with a draw bending machine 34, whereas FIG. 6 and FIG. 7 show respectively the use of the same apparatus 10, in a version that has five mandrel segments 18, with a calendering machine 35 and the use of the apparatus 110 with said calendering machine 35.

As shown, the draw bending machine 34, which is of known type, comprises a template 36, a vise 37, which is adapted to be closed against the template in order to clamp the part to be processed, and a retention element, in two parts 38*a* and 38*b*, which is adapted to keep in position the tube 12 to be bent in the region upstream of its portion to be bent.

The calendering machine 35 (also shown in FIG. 7), of known type, comprises a set of rollers, including two guiding rollers 39*a* (often known as presser rollers) for the tube 12, a bending roller 39*b* and a forming roller 39*c*, the latter two being adapted to determine, by means of their mutual position, the curvature of the tube 12 at its exit therefrom.

With reference to FIGS. 5 and 6, the method according to the invention consists in:

- inserting the mandrel 11 in the tube 12 to be bent, with the sensor 23 integral with the mandrel segment 18 at the free end of the flexible portion 1,
- acquiring the position of the mandrel segment 18 with which the sensor 23 is integral,
- bending the tube 12 according to preset process parameters,
- detecting the motion and measuring the displacement of the mandrel segment 18, with which the sensor 23 is integral, during and/or after the bending of the tube 12,
- comparing the measured displacement with the preset process displacement and, if they are different, processing a correction to the process parameters,
- bending the tube 12 again or bending another tube according to the corrected process parameters.

Both in a bending process with a draw bending machine 34 and in a bending process with a calendering machine 35, as shown respectively in FIG. 5 and in FIG. 6, the insertion of the mandrel 11 into the tube 12 provides for the mandrel segment 18, with which the sensor 23 is integral, to be arrangeable in a portion of tube downstream of the portion not to be bent, as shown.

In particular, in the first case shown it is arranged in the portion to be bent, but as an alternative, with a larger number of mandrel segments than those shown, it can be arranged downstream of said portion to be bent.

With the mandrel 11 inserted, the initial position of said mandrel segment 18 is acquired.

The bending of the tube 12 must be performed according to preset process parameters, including the radius of curvature and the bending angle (measured with respect to the straight portion not to be bent).

During bending, motion detection and measurement of the displacement of the mandrel segment 18 occur with a sensor 23. In particular, in this step, by means of the sensor 23, the signals related to the motion of the mandrel segment 18 on which it is mounted are acquired and are transmitted from the sensor 23 to the processing means and then to a microcontroller or to hardware that is external to the mandrel 11, by virtue of the data transmission means (i.e., the data transmission cable 33 or by radiofrequency, with wireless communication), which process them to determine the angular displacement of the mandrel segment 18, and therefore its position. The processing can comprise the filtering and integration of the signals when the sensor is constituted by an accelerometer or by a gyroscope.

The inertial platform is in fact capable of detecting accelerations and/or angular velocities with respect to a reference system, and it is based on triaxial accelerometers and/or triaxial gyroscopes, and it is connected to the processing device that acquires the signals, processes them by integrating them in order to determine the angular displacement and by applying trigonometric formulas, and it makes them available in the form of coordinates in the chosen reference system, providing at each instant the updated position of the mandrel segment 18 on which the sensor 23 is installed.

For a draw bending machine 34, the bending requires the tube 12 to be clamped between the template 36 and the vise 37 and it requires these to be rotated integrally through the bending angle. With the calendering machine 35, on the other hand, after the placement of the mandrel 11 the forming roller 39*c* is lowered onto the tube 12, in the illustrated position, bending it downward (with respect to the illustration). By keeping the forming roller 39*c* in the same position, the tube 12 is pushed through the group of rollers during bending.

Then, when the draw bending machine 34 opens, moving the vise 37 away from the template 36, the elastic return of the bent part can be observed, as shown in FIG. 5.

The portion of tube 20 downstream of the bend, oriented in the position set by the design and when the machine is still closed, is shown in dashed lines, with the vise 37 also shown in dashed lines, whereas solid lines illustrate the same portion of tube 40, in the actual position, after the elastic return, with the machine open. The elastic return is shown with the angle comprised between the two positions of the tube portion 40 and is designated by the reference numeral 41.

The method provides that the motion detection and the measurement of the displacement of the mandrel segment 18 are performed in this interval of the method as well, if bending by means of a draw bending machine 34, and that these are performed in the manner already described for the bending interval.

In this time interval, in fact, the flexible portion 14 undergoes a flexing in the opposite direction with respect to the preceding bending direction: the sensor 23 and the processing means detect and process instant by instant the motion of the mandrel segment 18, which the sensor 23 is integral, returning the position and the measurement of the angular displacement of the point inside the tube 12 in which the sensor 23 is present, and therefore of the portion of tube 40 (up to the position of the sensor 23).

By using a calendering machine 35 instead, as shown in FIG. 6, the elastic return occurs simultaneously with the bending of the tube 12 and therefore the sensor 23 and the processing means are capable of providing the position and the measurement of the angular displacement of the point inside the tube 12 in which the sensor 23 is present, therefore substantially of the portion of tube 40 in which the mandrel segment 18 with the sensor 23 is arranged, instant by instant during bending, also taking into account elastic return. In this figure also, the portion of curved tube, which undergoes elastic return, is designated by the numeral 40 and is shown in dashed lines in the design position and in solid lines in the actual position at the exit from the set of rollers. The elastic return is indicated between the axes of the portion of tube 40 in the two positions and is again designated by the reference numeral 41.

In both processes, when the elastic return occurs, comparison between the measured angular displacement and the preset process displacement is used to detect a difference between the two and the method provides for processing a correction to the process parameters, which substantially consists of determining an overbending angle in the drawing process (given by the sum of the preset bending angle and of the calculated difference) and the variation of the center distance between the rollers in the calendering process, to which the tube 12 is to be subjected in order to obtain at the end of the process the bend set by design.

If the draw bending machine 34 is used, this is therefore closed again and the set constituted by the template 36 and the vise 37 is made to rotate through an angle that is greater than the preceding design angle, according to the corrected process parameters.

As an alternative, the tube 12, if it is not in a condition in which it can be processed again, is discarded and another, similar tube is bent according to the corrected process parameters.

Similarly, if the calendering machine 35 is used, the tube 12 is discarded and replaced with a similar one. The forming roller 39*c* is moved and the bending is repeated according to the corrected process parameters, and therefore with a new center distance between the rollers.

During this new bending, the motion detection and the measurement of the displacement of the mandrel segment 18 are performed again, as was done during the previous bending.

Finally, the mandrel 11 with the sensor 23 is extracted from the tube 12, at the same time detecting the motion and measuring the displacement of said mandrel segment 18, with which the sensor 23 is integral.

In this part of the method, any surface wrinkles at the bent portion of the tube 12 are identified by comparing the measured displacement with the expected displacement during extraction.

If the comparison detects that in the bent portion there have been one or more angular displacements of the mandrel segment 18 which are different from the expected ones, then there are wrinkles and the tube 12 is discarded when the difference of the values of angular displacement exceeds a preset threshold value.

In this interval of the method also, motion detection and measurement of the displacement are performed in the manner already described for the bending step.

The apparatus 10 is therefore capable of also identifying any surface defects, determining the number and extent of the wrinkles formed.

During the method described above, in both bending processes, the apparatus 10 is capable of providing instant by instant the displacement and position of the mandrel segment 18 during and/or after bending and therefore of determining the deviation of the actual deformation of the tube 12 from the sought nominal one.

If a calendering machine 35 is used, the same apparatus 10 can be used by arranging the mandrel segment with which the sensor is integral in a tube portion that is comprised between the rotation axis of the bending roller 39*b* and the rotation axis of the forming roller 39*c*, therefore in a region not affected by elastic return.

In this use, the method is fundamentally the same. In this case the detection and the measurement performed during the bending can in fact detect an angular displacement which, if compared with the one expected by design, can bring out a value of the radius of curvature that is different from the one preset by design.

In calculating the radius of curvature, one takes into account the fact that the position of the mandrel segment with the sensor is known in advance with the insertion of the mandrel into the tube and therefore the length of the arc that corresponds to the portion of tube 12 comprised between the point in which the sensor is arranged and the guiding roller 39*a* that precedes the forming roller 39*c* is also known. Furthermore, its angular displacement with respect to the straight position, acquired with detection and measurement, is also known. By means of the application of trigonometric formulas it is therefore possible to determine the radius of curvature of the tube 12.

The new position of the forming roller 39*c* must be modified until the apparatus 110 detects an angular position that corresponds, with a reverse calculation, to that of the sought radius of curvature.

With reference to FIG. 7, the method according to the invention is described below in the use of the apparatus 110 with a calendering machine 35.

If the mandrel 111 were provided with a single sensor 123 at the mandrel segment 118 at the free end, the apparatus 110 could be used in a manner similar to what has already been described for the apparatus 10.

In the illustrated case, the apparatus 110 makes it possible to deduce the actual deformation of the tube 12 instant by instant by obtaining the updated positions in multiple points simultaneously, and to measure the extent of the bending.

The method that uses the apparatus 110 consists in:

- inserting the mandrel 111 in the tube 12 to be bent,
- acquiring the position of each mandrel segment 118 with which the respective sensor 123 is integral,
- bending the tube 12 according to preset process parameters,
- detecting the motion and measuring the displacement of each mandrel segment 118 with which the respective sensor 123 is integral, during the bending of the tube 12,
- comparing the measured displacement with the preset process displacement and, if they are different, processing a correction to the process parameters,
- bending the tube 12 again or bending another tube according to the corrected process parameters.

The calendering machine 35 shown is similar to the one already described and illustrated in FIG. 6, with guiding rollers 39*a*, a bending roller 39*b* and a forming roller 39*c*.

The mandrel 111 is inserted into the tube 12, arranging at least one mandrel segment 118, three in the illustrated case, with each one of which a sensor 123 is integral, in a portion of tube 12 that is comprised between the rotation axis of the bending roller 39*b* and the rotation axis of the forming roller 39*c*, and at least one mandrel segment 118, one in the case shown (the one at the free end of the mandrel 111), in a portion of tube 12 downstream of the portion not to be bent.

In this situation, the position of mandrel segments 118 in the portion of tube 12 to be curved and at the same time of mandrel segments 118 in the portion of tube 12 comprised between the axes of the rollers, the bending roller 39*b* and the forming roller 39*c*, is acquired.

The bending of the tube 12 must be performed according to preset process parameters, including the radius of curvature and the bending angle.

In the calendering process, after the placement of the mandrel 111 the forming roller 39*c* is lowered onto the tube 12, in the illustrated position, bending it downward (with respect to the illustration).

The tube 12 is then pushed through the set of rollers during bending and at the same time the phenomenon of an elastic return can occur.

During bending, motion detection and measurement of the displacement of each mandrel segment 118 in which the sensor 123 is present are performed.

In particular, by means of the sensor 123 the signals related to the motion of the mandrel segment 118 on which it is mounted are acquired, and as already described in the use of the apparatus 10 these are transmitted from the sensor 123 to the processing means, therefore to a microcontroller or to hardware that is external to the mandrel 111, by virtue of the data transmission means, preferably radiofrequency transmission or with a data transmission cable, if present. The processing means process the signals received to determine the angular displacement of each mandrel segment 118 and therefore their position instant by instant along the tube 12. The processing comprises filtering and integration of the signals when the sensors 123 are constituted by an accelerometer or by a gyroscope.

In the manner already described, the inertial platform processes by integrating the signals in order to determine the angular displacements and by applying trigonometry formulas and makes them available in the form of coordinates in the chosen system, providing at each instant the updated position of each mandrel segment 118 on which a sensor 123 is installed.

From the beginning of the bending, the position and the measurement of the angular displacement of the part of tube 12 in which the sensors 123 are present are provided.

Also in this figure, dashed lines show the portion of tube 40, which is curved according to the deformation preset by design, and the solid line shows the actual portion of tube 40.

The elastic return is again designated by the reference numeral 41.

The sensor 123 and the processing means detect and process instant by instant the motion of each mandrel segment 118, with which a respective sensor 123 is integral, returning the measurement of the angular displacement of the portion of tube 40, in each point where a sensor 123 is present.

From the comparison between the angular displacement measured in these points and the preset process displacement, a difference between the two is detected and the method therefore provides for the processing of a correction to the process parameters.

In particular, angular displacements of the mandrel segments 118 in the curved portion that differ from those expected by design identify elastic return, while any displacements in the portion comprised between the axis of the bending roller 39*b* and the axis of the forming roller 39*c* indicate a value of the radius of curvature that is different from the one preset by design.

In the first case, the difference between the preset angular displacement and the measured angular displacement makes it possible to determine the overbending, by varying the center distance between the rollers in order to modify accordingly the position of the forming roller 39*c* with respect to the bending roller 39*b*.

In the second case, on the other hand, the new position of the forming roller 39*c* must be modified until the apparatus 110 detects an angular position that corresponds to that of the sought radius of curvature.

It is therefore possible to evaluate in real time any deviation of the actual deformation with respect to the nominal deformation set by the operator in order to compensate for any errors by varying the position of the forming roller 39*c* according to the corrected process parameters.

As an alternative, the tube 12 is discarded and replaced with a similar one. The forming roller 39*c* is moved and the bending is repeated on the new tube according to the corrected process parameters, therefore with a new center distance between the rollers.

With the apparatus 110 as well, the extraction of the mandrel 111 from the tube 12 is performed while detecting the motion and measuring the displacement of each mandrel segment 118 with which a sensor 123 is integral.

During this operation, any surface wrinkles at the bent portion of tube 12 are detected by comparing the displacement measured in the mandrel segment 118 arranged in the curved portion, at the end of the bending process, with the expected displacement during extraction. The tube 12 is rejected when the difference between the measured displacement and the expected displacement exceeds a preset threshold value.

During extraction, the motion detection and the measurement of the displacement are performed in the manner already described for the bending step.

The possibility to detect the presence, number and extent of wrinkles makes it possible to reject nonconforming pieces without further checking operations on the bent tube.

The method according to the invention is a quick and effective method for process monitoring and it allows low-cost checks even by using dated bending machines which are not equipped with sensors of another type.

The apparatus 10, 110 and the described methods make it possible to evaluate any elastic return of the tube 12, by measuring instantaneously and directly the deviation of the actual profile from the nominal one set by the operator, and to compensate for any displacement without extracting the device from the tube and the latter from the bending machine until the bending process ends.

Furthermore, by virtue of the apparatus and methods described it is also possible to monitor bending processes that require the execution of a series of bends, with subsequent reorientations of the tools, for example of the set of templates and rollers, simply by repositioning the mandrel in the region affected by the bend, without extracting it from the tube.

The apparatus according to the invention therefore lends itself to be used in automated industrial processes.

In practice it has been found that the invention achieves the intended aim and objects, by proposing an apparatus and a method for improving the bending of tubes which can be applied to multiple types of bending process, by precisely measuring their deformation and any elastic return thereof, directly and in real time.

The apparatus according to the invention in fact lends itself to monitoring the process of bending by calendering, since the measurement of the curvature and of the elastic return does not require the relative orientation of two straight portions.

The apparatus has been found to be able to monitor any surface defects and any deviations of the actual profile of the deformed tube from the nominal one set by design and to compensate for any deformation errors during the bending process itself and without having to extract the part from the bending machine before all the operations have ended.

Another advantage has been found in that monitoring can be performed continuously for bending processes that require the execution of a series of bends.

A further advantage of the device according to the invention is that it is capable of meeting multiple requirements, i.e., of avoiding the collapse of the tube and at the same time monitoring the deformation and also detecting the presence of surface defects.

The invention thus conceived is susceptible of numerous modifications and variations, all of which are within the scope of the accompanying claims; all the details may furthermore be replaced with other, technically equivalent elements.

In practice, the materials used, so long as they are compatible with the specific use, as well as the contingent shapes and dimensions, may be any according to the requirements and the state of the art.

The disclosures in Italian Patent Application no. PD2015A000068 (102015902342094), from which this application claims priority, are incorporated herein by reference.

The invention claimed is:

1. An apparatus for improving the quality of tube bending, adapted to be used in bending machines and comprising a substantially longitudinally extended mandrel, adapted to be inserted in a tube to be bent and having a rigid portion and a flexible portion arranged in series, said flexible portion comprising a series of mandrel segments connected by articulated joints, said apparatus comprising:

at least one sensor, which is integral with at least one mandrel segment of said series of mandrel segments and is configured as a motion-sensitive sensor arranged to detect orientation and displacements of said at least one mandrel segment, and processing means, for processing motion information acquired by said at least one sensor.

2. The apparatus according to claim 1, wherein said at least one sensor is installed at a free end of said flexible portion.

3. The apparatus according to claim 1, wherein said at least one sensor is accommodated within said at least one mandrel segment.

4. The apparatus according to claim 1, wherein said processing means comprise at least one software program and at least one processing device, to be used together with said software program, which are adapted to measure the movements of said at least one mandrel segment.

5. The apparatus according to claim 4, wherein said at least one processing device comprises at least one microcontroller and said at least one sensor.

6. The apparatus according to claim 1, further comprising data transmission means for transmitting data from said at least one sensor to said processing means.

7. The apparatus according to claim 6, wherein said data transmission means comprise at least one data transmission cable which connects said at least one sensor to said processing means by passing through at least one first hole, which passes longitudinally through said rigid portion, and a series of second holes, each one of which passes through said at least one mandrel segment, in series with said at least one first hole.

8. The apparatus according to claim 1, wherein said at least one sensor is an accelerometer and/or a gyroscope.

9. A method that uses the apparatus according to claim 1, comprising:

inserting said mandrel in said tube, acquiring a position of said at least one mandrel segment by said at least one sensor, bending said tube according to preset process parameters, detecting motion and measuring displacement of said at least one mandrel segment, by said at least one sensor, during bending and/or after bending of said tube, comparing the measured displacement with a preset process displacement and, if they are different, processing a correction to said process parameters, bending said tube again or bending another tube according to the corrected process parameters.

10. The method according to claim 9, wherein bending of said tube is carried out with a draw bending machine and/or with a calendering machine, and wherein the insertion of said mandrel in said tube is carried out by arranging said at least one mandrel segment in a portion of said tube downstream of a portion of said tube not to be bent.

11. The method according to claim 9, wherein bending said tube is carried out with a calendering machine comprising a bending roller and at least one forming roller between which said tube is pushed, the position of the said at least one forming roller being modifiable with respect to the position of said bending roller, and wherein inserting said mandrel in said tube is carried out by arranging said at least one mandrel segment in a portion of said tube that is comprised between a rotation axis of said bending roller and a rotation axis of said at least one forming roller.

12. The method according to claim 9, further comprising the extraction of said mandrel from said tube, while detecting motion and measuring displacement of said at least one mandrel segment.

13. The method according to claim 9, wherein detecting motion and measuring displacement of said at least one mandrel segment comprises:

acquiring signals related to the motion of said at least one mandrel segment by said at least one sensor, transmitting said signals from said at least one sensor to said processing means, processing said signals, by said processing means, to determine an angular displacement of said at least one mandrel segment.

* * * * *